US005554002A

United States Patent [19]

Yoo

[11] Patent Number: 5,554,002

[45] Date of Patent: Sep. 10, 1996

[54] ELECTRIC FAN HAVING TWO WIND SHIFTING MODES

[76] Inventor: In Man Yoo, 120-1305 Mokdongshinshigazi Apartment, Mok-Kong, Yangchon-ku, Seoul, Rep. of Korea

[21] Appl. No.: 440,252

[22] Filed: May 12, 1995

[30] Foreign Application Priority Data

May 19, 1994 [KR] Rep. of Korea ..... 1994/11053

[51] Int. Cl.[6] ..... F04D 25/10

[52] U.S. Cl. ..... 416/100; 416/110/169 R

[58] Field of Search ..... 416/100, 110, 416/169 R, 172

[56] References Cited

U.S. PATENT DOCUMENTS

| | | | |
|---|---|---|---|
| 1,373,480 | 4/1921 | Brainerd | 416/100 |
| 2,794,591 | 6/1957 | Rodriguez | 416/110 |
| 4,472,110 | 9/1984 | Sun Keu | 416/100 |

FOREIGN PATENT DOCUMENTS

| | | |
|---|---|---|
| 92-15257 | 8/1992 | Rep. of Korea . |
| 94-22984 | 10/1994 | Rep. of Korea . |

*Primary Examiner*—Edward K. Look
*Assistant Examiner*—James A. Larson
*Attorney, Agent, or Firm*—Longacre & White

[57] ABSTRACT

An electric fan having unidirectional and opposed-directional wind shifting modes is disclosed. The wind shifter of the fan has a drive shaft and an output shaft set in a housing. A unidirectional rotating unit of the wind shifter has a first pinion and a pinion gear. The pinion gear is rotatably fitted over the output shaft and selectively coupled to this shaft by a clutch. An opposed-directional rotating unit of the wind shifter has a second pinion, a crank gear gearing into the second pinion, and a reciprocating rotation disc rotatably fitted over the output shaft and selectively coupled to the output shaft by clutch. The unidirectional or opposed-directional rotating force of the output shaft is transmitted to the head of the fan through a revolving pulley cooperating with a sun pulley of the neck of the fan.

3 Claims, 4 Drawing Sheets

ELECTRIC FAN HAVING TWO WIND SHIFTING MODES

BACKGROUND OF THE INVENTION

1. Field of the Invention

The present invention relates in general to an electric fan with a head capable of unidirectionally or opposed-directionally rotating and thereby shifting the direction of the wind in the two modes and, more particularly, to a structural improvement in a wind shifter of such a fan for carrying out either of the unidirectional wind shifting motion and the opposed-directional wind shifting motion using a common output shaft.

2. Description of the Prior Art

In the art, electric fans having two wind shifting modes capable of unidirectionally or opposed-directionally shifting the direction of the wind are known, for example, from Korean U.M. Appln. No. 91-22079 filed by the applicant. It has been noted that a unidirectional wind shifting fan, whose head unidirectionally rotates and thereby unidirectionally shifting the direction of the wind, is preferably used in a large place, such as a workshop, whereinto people crowd. However, such a fan has a problem that the effective airflow of the fan is somewhat reduced and this deteriorates utility of the fan. In an effort to overcome the problem of the typical unidirectional wind shifting fan, the applicant proposed the fan having two wind shifting modes by the above Korean utility model application. In this fan, a mandrel shaft is concentrically sleeved by a sleeve shaft, thus to form a dual output shaft for rotating the head of the fan. The two shafts of the dual output shaft charge the unidirectional wind shifting mode and the opposed-directional wind shifting mode of the fan respectively. That is, when the mandrel shaft of the dual output shaft rotates by the rotating force of a motor, the head of the fan alternately rotates in opposed-directions by a crank and a crank rod, both being provided on the end of the mandrel shaft. In this case, the direction of the wind of the fan is opposed-directionally shifted by the reciprocating rotation of the head. On the contrary, when the rotating force of the motor is applied to the sleeve shaft of the dual output shaft, a revolving pulley fitted over the end of the sleeve shaft unidirectionally revolves round a sun pulley, which pulleys are connected to each other by an endless belt. In this case, the direction of the wind is unidirectionally shifted.

In order to selectively transmit the rotating force of the motor to either of the two shafts of the dual output shaft, the above fan having two wind shifting modes has an output switching device. In Korean U.M. Appln. No. 93-3852, there is proposed an improved clutch for achieving smooth motion for switching the wind shifting mode of the fan between the two modes, that is, the unidirectional mode and the opposed-directional mode.

The typical fan having the two wind shifting modes has a problem that the fan shifts the direction of the wind by means of one of two exterior units provided in the exterior of a housing. That is, when the mandrel shaft of the dual output shaft rotates, the direction of the wind is opposed-directionally shifted by the first unit, comprising the crank and crank rod. On the contrary, when the sleeve shaft of the dual output shaft rotates, the direction of the wind is unidirectionally shifted by the unidirectional revolution of the revolving pulley of the sleeve shaft round the sun pulley connected to the revolving pulley by the belt, which pulleys and belt constitute the second unit. The two exterior units for wind shifting operation enlarge the size of the fan and may cause trouble of the fan, and make fabrication of the fan be difficult. Another problem of the fan is resided in that the opposed-directional revolution angle of the pulley revolving round the sun pulley or the reciprocating rotation angle of the head of the fan is inevitably limited to 180°.

SUMMARY OF THE INVENTION

It is, therefore, an object of the present invention to provide an electric fan having two wind shifting modes in which the above problems can be overcome and whose unidirectional rotating unit and an opposed-directional rotating unit are set in a housing of a wind shifter, thus to simplify the appearance and construction of the fan.

It is another object of the present invention to provide an electric fan having two wind shifting modes which selectively carries out unidirectional or opposed-directional wind shifting motion using a common output shaft.

It is still another object of the present invention to provide an electric fan having two wind shifting modes which makes the rotating reciprocation angle of the head of the fan be larger than 180°.

In order to accomplish the above object, an electric fan having a wind shifter for shifting the direction of the wind of the fan in a unidirectional wind shifting mode or in an opposed-directional wind shifting mode, wherein the wind shifter comprises: a drive shaft and an output shaft set in a wind shifter housing and parallel to each other, the drive shaft being applied with rotating force of a motor, and the output shaft having a revolving pulley cooperating with a sun pulley of a neck of the fan and unidirectionally or opposed-directionally rotating a head of the fan; clutch means provided on the output shaft; a unidirectional rotating unit including: a first pinion tightly fitted over the drive shaft; and a pinion gear gearing into the first pinion and rotatably fitted over the output shaft and selectively coupled to the output shaft by means of the clutch means; and an opposed-directional rotating unit including: a second pinion tightly fitted over the drive shaft; a crank gear gearing into the second pinion and mounted to the wind shifter housing by means of a shaft pin; a reciprocating rotation disc rotatably fitted over the output shaft and selectively coupled to the output shaft by means of the clutch means; and a crank rod connecting the crank gear to the disc and converting rotation of the crank gear into reciprocating rotation of the disc.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
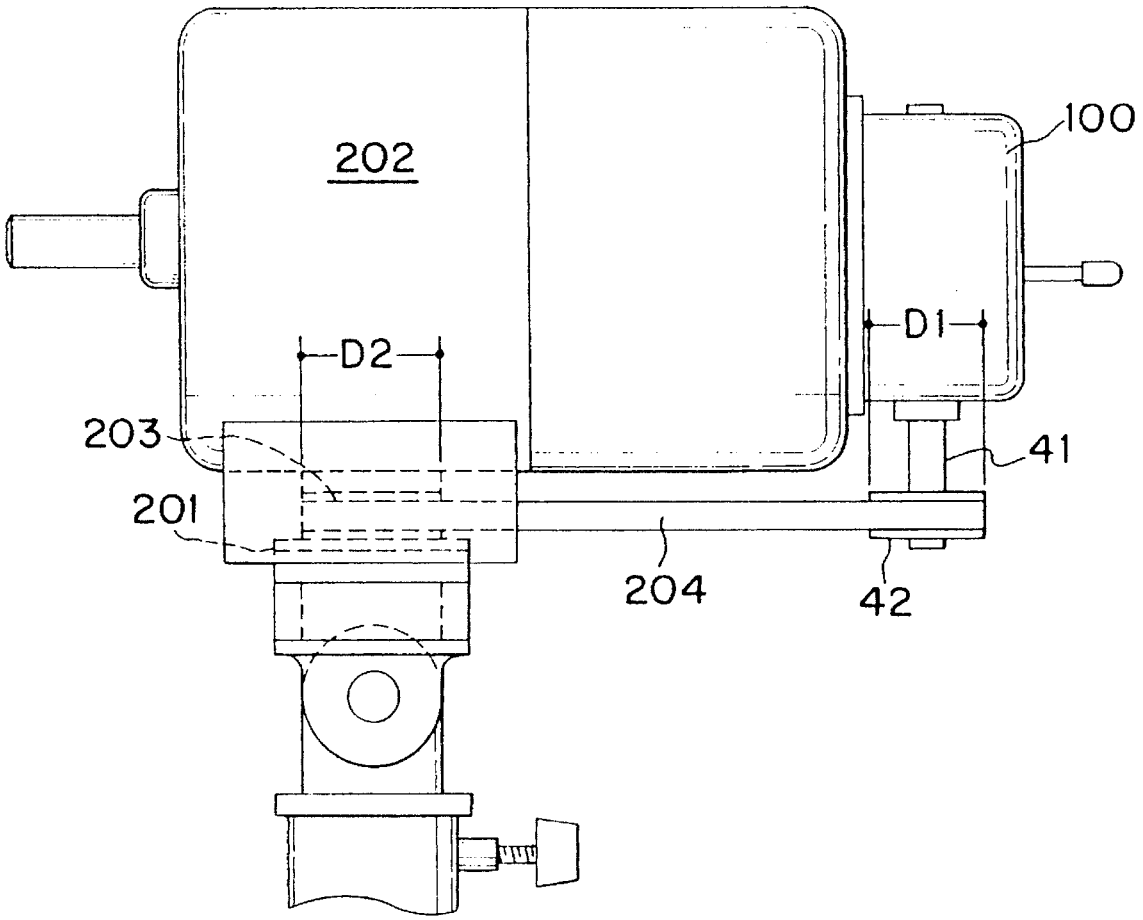
FIG. 1 is a side view of a head of the electric fan in accordance with an embodiment of the present invention, the vane of which electric fan is omitted.
Figure 2:
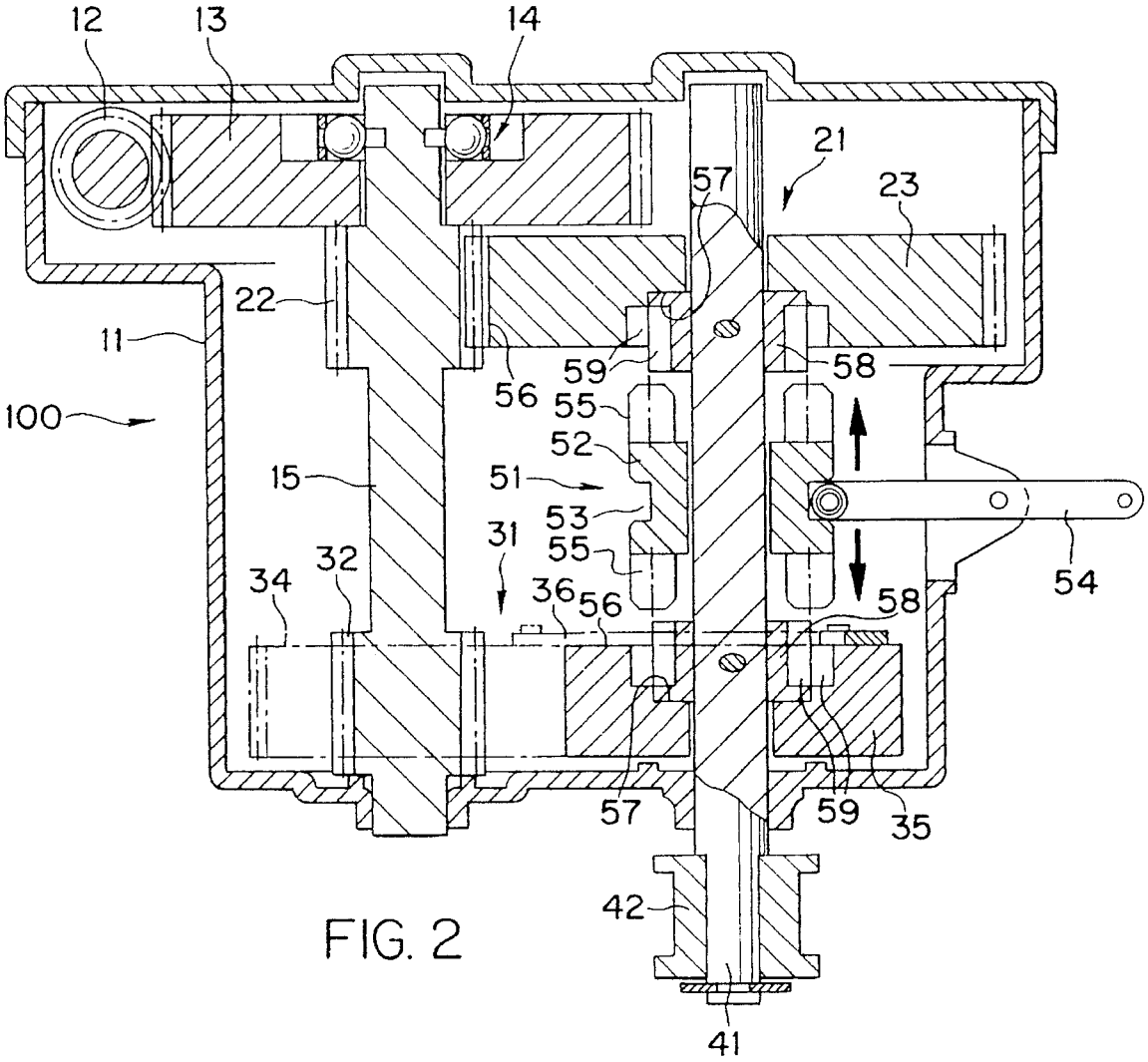
FIG. 2 is an enlarged sectional view of a wind shifter of the electric fan of the invention.

FIG. 1 is a side view of a head of the electric fan in accordance with an embodiment of the present invention, the vane of which electric fan is omitted. As shown in the drawing, a wind shifter 100 for shifting the direction of the wind is mounted to the back of a main motor 202 of the electric fan (hereinafter, referred to simply as "the fan"), which motor 202 is applied with electric power from a brush 201. An output shaft 41 extends downward in the wind shifter 100. The wind shifter 100 is applied with the rotating force of the motor 202 and in turn applies the rotating force to the shaft 41 through a power transmission mechanism set in a housing 11 (see FIG. 2), thus to unidirectionally or opposed-directionally rotate the shaft 41. A revolving pulley 42 is fitted over the free end of the shaft 41 and cooperates with a sun pulley 203 through an endless belt 204, which belt 203 is wrapped about the pulleys 42 and 203. The sun pulley 203 mounted to the neck of the fan in order for rotating the head of the fan. The revolving pulley 42 may be unidirectionally or opposed-directionally rotated in accordance with rotation mode of the shaft 41. When the revolving pulley 42 unidirectionally rotates, the pulley 42 continues unidirectional revolution round the sun pulley 203. When the revolving pulley 42 opposed-directionally rotates, the pulley 42 partially revolves round the sun pulley 203 in a direction and reverses its revolving direction so as to partially revolve round the sun pulley 203 in reversed direction, and the opposed-directional revolution of the revolving pulley 42 is repeated. That is, the wind shifter 100 switches the rotating motion of the head of the fan between the unidirectional rotation and the reciprocating rotation, thus to switch the wind shifting mode between the unidirectional shifting mode and the opposed-directional shifting mode.

A drive shaft 15 is disposed in the housing 11 such that the shaft 15 is parallel to the output shaft 41. The revolving pulley 42 is fitted over the free end of the output shaft 41.

In the wind shifter 100, a worm screw 12 is coupled to the main motor 202 and transmits the rotating force of the motor 202 to a worm gear 13 while reducing the rotational speed of the motor 202. The worm gear 13 in turn transmits the reduced rotating force to the drive shaft 15 through a slip bearing 14.

A clutch 51 is mounted on the middle portion of the output shaft 41 in the housing 11. In the housing 11, the output shaft 41 is also provided with a unidirectional rotating unit 21 and an opposed-directional rotating unit 31, which units 21 and 31 are placed above and below the clutch 51 respectively. The clutch 51 is adapted for coupling either one of the units 21 and 31 to the output shaft 41.

The unidirectional rotating unit 21 includes a pair of gear wheels, that is, a first pinion 22 and a pinion gear 23. The first pinion 22 is tightly fitted over the upper portion of the shaft 15, while the pinion gear 23 gearing into the pinion 22 is rotatably fitted over the output shaft 41 and selectively coupled to the output shaft 41 by means of the clutch 51 so as to transmit the rotating force of the pinion 22 to the output shaft 41.

Figure 3:
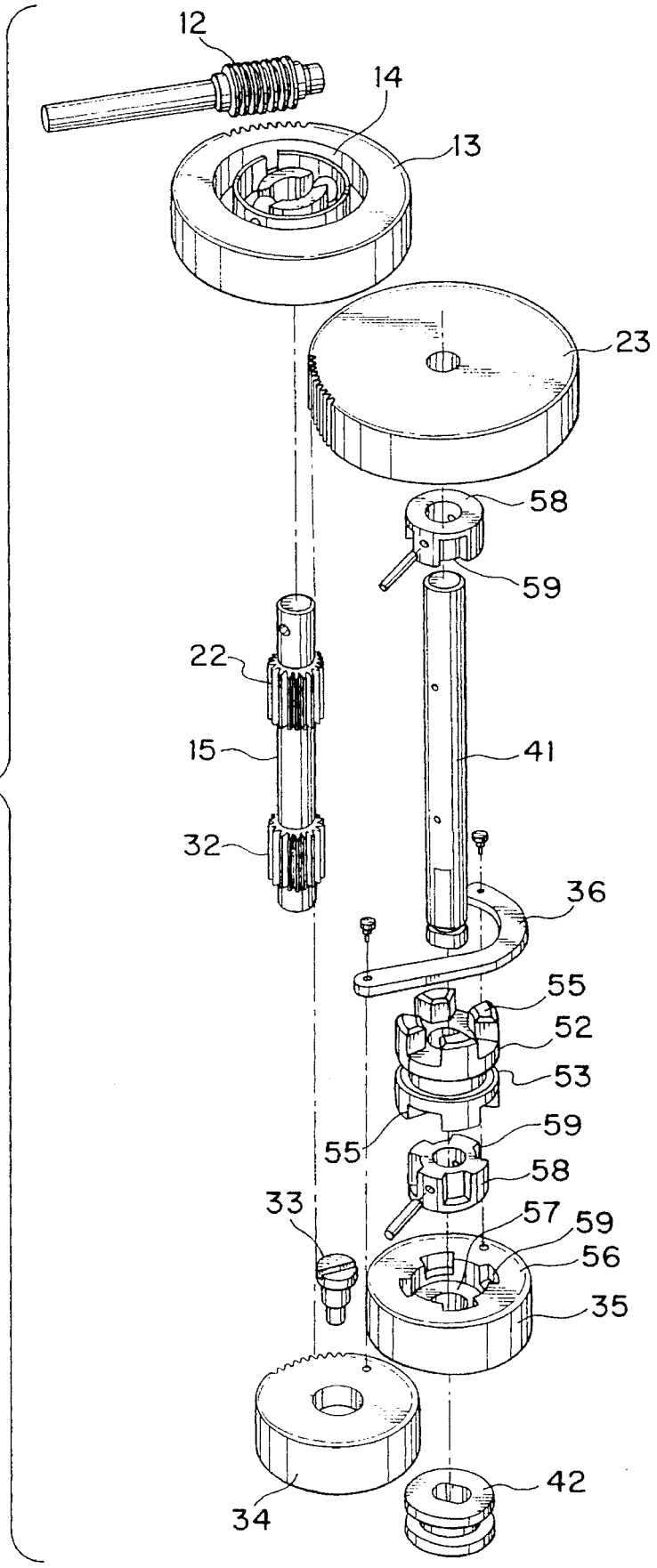
FIG. 3 is an exploded perspective view of the wind shifter of FIG. 2, showing a construction of the wind shifter.
Figure 4:
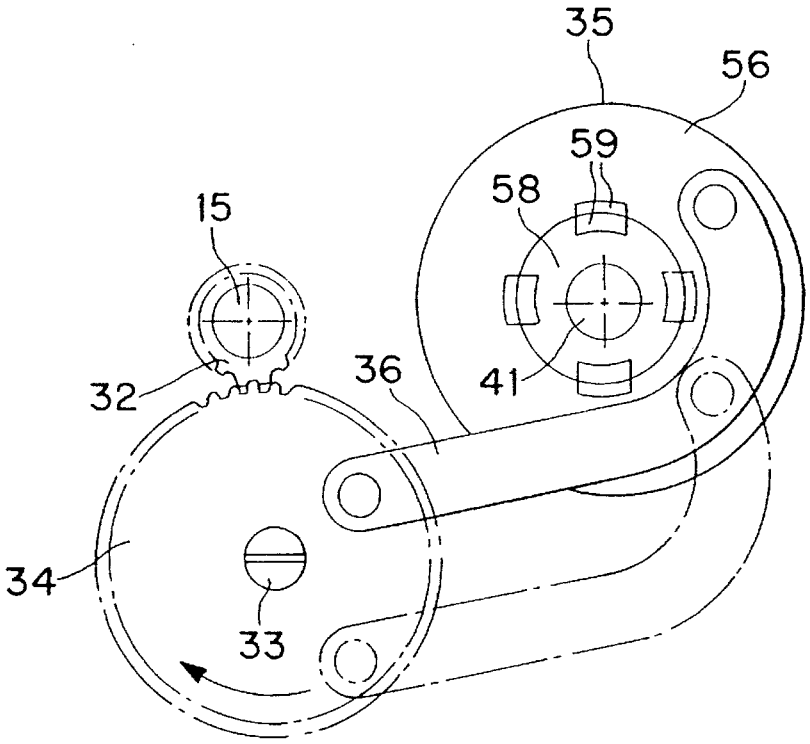
FIG. 4 is a schematic view showing a mechanism of the wind shifter for reciprocating rotation of the head of the electric fan of the invention.
Figure 5:
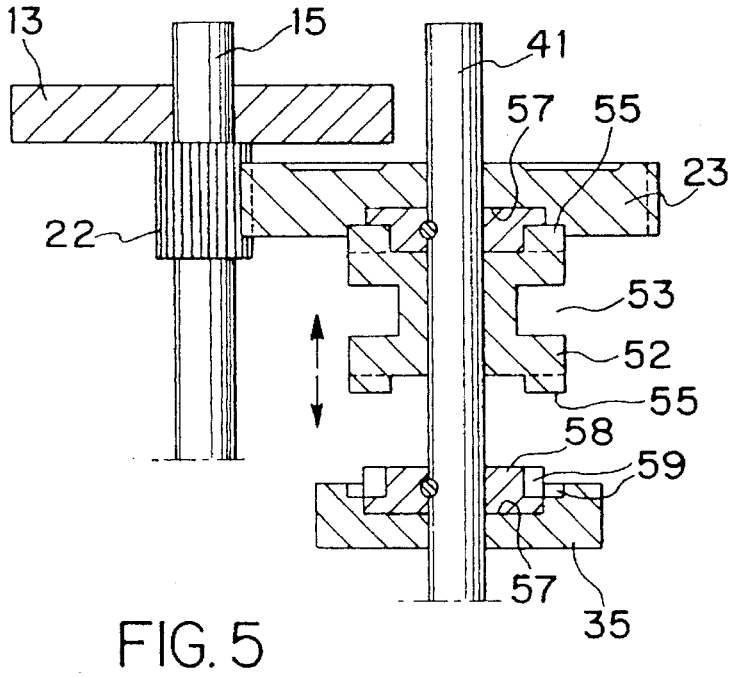
FIG. 5 is a sectional view showing a mechanism of the wind shifter for unidirectional rotation of the electric fan of the invention.

The opposed-directional rotating unit 31 includes a pair of gear wheels, that is, a second pinion 32 and a crank gear 34. The second pinion 32 is tightly fitted over the lower portion of the drive shaft 15, while the crank gear 34 gearing into the pinion 32 is mounted to the housing 11 by means of a shaft pin 33 (see FIG. 3). The unit 31 also includes a reciprocating rotation disc 35 which is rotatably fitted over the output shaft 41 and selectively coupled to the output shaft 41 by means of the clutch 51. The unit 31 further includes a crank rod 36 which connects the crank gear 34 to the disc 35 and converts the rotating motion of the gear 34 into the reciprocating rotation of the disc 35.

In the present invention, it is preferred to make the crank rod 36 be smoothly bent such that the rod 36 is prevented from contact with the output shaft 41. Of course, it should be understood that the position of the units 21 and 31 may be exchanged with each other.

The clutch 51 includes a drum 52, which drum 52 is movably fitted over the output shaft 41 between the pinion gear 23 and the disc 35 such that the drum 52 can be axially moved along the shaft 41. The outside surface of the drum 52 is provided with a slot 53 for coupling an end of a clutch lever 54 to the drum 52. When levering the drum 52 up or down by the lever 54, the clutch 51 couples either one of the pinion gear 23 of the unit 21 and the disc 35 of the unit 31 to the output shaft 41. The clutch lever 54 is handled by a three-position stabilizer (not shown).

If described in detail the construction of the clutch 51, each of the top and bottom of the drum 52 is provided with a plurality of teeth or inserts 55. The coupling surface 56 of the pinion gear 23 and the coupling surface 56 of the disc 35 each have their center holes 57. A guide disc 58 is fixedly fitted over the output shaft 41 and inserted in the center hole 57 of each of the pinion gear 23 and the reciprocating rotation disc 35 such that there is a slip between the contact surface of the guide disc 58 and the center hole 57. In order for letting pinion gear 23 and the disc 35 engage with the top and bottom inserts 55 of the drum 52 respectively, the same number of coupling slots 59 are formed in the center holes 57 and on the guide discs 58 of the gear 23 and of the disc 35.

In the present invention, the diameter D1 of the revolving pulley 42 may be larger than the diameter D2 of the sun pulley 203. In this case, the opposed-directional revolution angle of the pulley 42 revolving round the sun pulley 203 will be larger than 180° and this makes the reciprocating rotation angle of the head of the fan be larger than 180°.

That is, the relation between the rotational angle θ1 of the revolving pulley 42 and the wind shifting angle θ2 of the fan as a function of the diameters D1 and D2 of the pulleys 42 and 203 is given in Table 1.

TABLE 1

| D1(mm) | D2(mm) | θ1(°) | θ2(°) |
|---|---|---|---|
| 100 | 100 | 120 | 120 |
| 100 | 50 | 120 | 240 |
| 100 | 200 | 120 | 60 |

In this case, the angle θ2 will be represented by the following equation (1).

$$\theta 2=\theta 1\times(D1/D2) \quad (1)$$

Therefore, in order to make the angles θ1 and θ2 be 160° and 210° respectively, the diameter D2 of the sun pulley 203 will be calculated from the above equation (1).

That is, $$210°(\theta 2)=160°(\theta 1)\times(D1/D2), \text{ so that}$$

$$D2=(160°/210°)\times D1$$

Otherwise stated, the diameters D1 and D2 of the pulleys and 203 are determined in such a manner that the diameter D2 of the sun pulley 203 is smaller than the diameter D1 of the revolving pulley 42 by a ratio or $\theta 1/\theta 2$.

In the electric fan of the invention, the exterior unit of the wind shifter 100, which unit is exposed to the exterior of the housing 11 of the wind shifter 100, includes three parts, that is, the revolving pulley 42, fitted over the free end of the output shaft 41, and the sun pulley 203, mounted to the neck of fan and rotating the head of the fan, and the belt 204 wrapped about the pulleys 42 and 203 and connecting the two pulleys 42 and 203 to each other. It will be thus noted that the exterior unit of the instant wind shifter 100 has a simple construction.

When the revolving pulley 42 unidirectionally revolves round the sun pulley 203, the direction of the wind of the fan is unidirectionally shifted. However, when the revolving pulley 42 alternately revolves round the sun pulley 203 in opposed directions, the direction of the wind of the fan is opposed-directionally shifted.

In operation of the interior unit of the wind shifter 100, which interior unit is set in the housing 11 of the wind shifter 100, the worm screw 12 coupled to the main motor 202 transmits the rotating force of the motor 202 to the worm gear 13 while reducing the rotational speed of the motor 202. The worm gear 13 in turn transmits the reduced rotating force to the drive shaft 15, thus to rotate the two pinions 22 and 32 of the drive shaft 15 at the same time. The first pinion 22 unidirectionally rotates the pinion gear 23, while the second pinion 32 unidirectionally rotates the crank gear 34. Due to rotation of the crank gear 34, the reciprocating rotation disc 35 connected to the crank gear 34 by means of the crank rod 36 alternately rotates in opposed directions. That is, unidirectional rotation of the crank gear 34 causes opposed-directional rotation or reciprocating rotation of the disc 35.

When the clutch 51 is in the neutral position and separates the disc 35 from the output shaft 41 in this case, the output shaft 41 is not rotated even though the disc 35 is in the reciprocating rotation. The direction of the wind of the fan in this case is thus not shifted but fixed.

When levering up the drum 52 of the clutch 51 by the lever 54 in order to engage the top teeth 55 of the drum 52 with the coupling slots 59 of the pinion gear 23, the unidirectional rotating force of the gear 23 is transmitted to the output shaft 41 through the clutch 51, thus to continuously unidirectionally rotate the output shaft 41 with the revolving pulley 42. The direction of the wind of the fan in this case is thus unidirectionally shifted. On the contrary, when levering down the drum 52 in order to engage the bottom teeth 55 of the drum 52 with the coupling slots 59 of the disc 35, the reciprocal rotating force of the disc 35 is transmitted to the shaft 41 through the clutch 51, thus to alternately rotate the shaft 41 with the revolving pulley 42 in opposed directions. Therefore, the direction of the wind of the fan in this case is opposed-directionally shifted.

In operation of the clutch 51, when levering up or down the drum 52 by the lever 54, the drum 52 slides up or down along the output shaft 41 and comes closer to either the coupling surface 56 of the gear 23 or the coupling surface 56 of the disc 35. The top or bottom teeth 55 of the drum 52 are, thereafter, inserted into their associated coupling slots 59 of a guide disc 58, thus to integrate the drum 52 with the guide disc 58. The teeth 55 in turn engage with their associated coupling slots 59 of the coupling surface 56. The above clutching operation is orderly smoothly carried out in order for connecting either of the pinion gear 23 and the disc 35 to the output shaft 41.

As described above, the present invention provides an improved electric fan whose wind shifter includes a unidirectional rotating unit and an opposed-directional rotating unit, which units are placed about an output shaft in the housing of the wind shifter. With the above two units, the output shaft of the wind shifter unidirectionally or opposed-directionally shifts the direction of the wind of the fan. In the instant fan, the opposed-directional revolution angle of the pulley revolving round the sun pulley can be larger than 180° so that the reciprocating rotation angle of the head of the fan can be larger than 180° and this makes the wind shifting angle of the fan in opposed-directional wind shifting mode be larger than 180° .

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An electric fan having a wind shifter for shifting the direction of the wind of the fan in a unidirectional wind shifting mode or in an opposed-directional wind shifting mode, wherein said wind shifter comprises:

a drive shaft and an output shaft set in a wind shifter housing and parallel to each other, said drive shaft being applied with rotating force of a motor, and said output shaft having a revolving pulley cooperating with a sun pulley of a neck of the fan and unidirectionally or opposed-directionally rotating a head of the fan;

clutch means provided on said output shaft;

a unidirectional rotating unit including:

a first pinion tightly fitted over said drive shaft ;and a pinion gear gearing into said first pinion and rotatably fitted over the output shaft and selectively coupled to the output shaft by means of said clutch means; and an opposed-directional rotating unit including:

a second pinion tightly fitted over said drive shaft;

a crank gear gearing into the second pinion and mounted to the wind shifter housing by means of a shaft pin;

a reciprocating rotation disc rotatably fitted over the output shaft and selectively coupled to the output shaft by means of the clutch means; and a crank rod connecting the crank gear to the disc and converting rotation of the crank gear into reciprocating rotation of the disc.

2. The electric fan according to claim 1, wherein said clutch means comprises:

a drum movably fitted over the output shaft between the pinion gear and the reciprocating rotation disc;

a clutch lever coupled to said drum and adapted for levering up or down the drum;

insert means provided on the top and bottom of said drum;

two guide discs fixedly fitted over the output shaft and inserted in a center hole of the pinion gear and in a center hole of the reciprocating rotation disc respectively such that there is a slip between the guide discs and their associated center holes; and slot means formed in the center holes and on the guide discs and adapted for selectively receiving the insert means of the drum and thereby fixing the pinion gear and the reciprocating rotation disc to their associated guide discs.

3. The electric fan according to claim 1, wherein a wind shifting angle of the fan in the opposed-directional wind shifting mode is larger than 180°.

* * * * *